United States Patent [19]

Oksuzler

[11] Patent Number: 4,575,281

[45] Date of Patent: Mar. 11, 1986

[54] METHOD AND STRUCTURE FOR FORMING AN OFFSHORE FACILITY

[75] Inventor: Yalcin Oksuzler, Plano, Tex.

[73] Assignee: Mobil Oil Corporation, New York, N.Y.

[21] Appl. No.: 525,539

[22] Filed: Aug. 23, 1983

[51] Int. Cl.[4] ..... E02B 15/02

[52] U.S. Cl. ..... 405/217; 405/195; 405/203; 405/204

[58] Field of Search ..... 405/217, 203, 204, 195, 405/205–208, 222, 223

[56] References Cited

U.S. PATENT DOCUMENTS

| | | | |
|---|---|---|---|
| 3,464,212 | 9/1969 | Yamagata et al. | 405/204 |
| 4,103,502 | 8/1978 | Cashman | 405/195 |
| 4,456,072 | 6/1984 | Bishop | 405/217 X |
| 4,470,725 | 9/1984 | Kure et al. | 405/217 X |
| 4,512,684 | 4/1985 | Hale et al. | 405/195 X |

FOREIGN PATENT DOCUMENTS

| | | | |
|---|---|---|---|
| 1210952 | 10/1959 | France | 405/204 |
| 1603517 | 11/1981 | United Kingdom | 405/217 |

*Primary Examiner*—Dennis L. Taylor

*Attorney, Agent, or Firm*—A. J. McKillop; Michael G. Gilman; Frank J. Kowalski

[57] ABSTRACT

An offshore facility is formed by positioning an open top container having a barge therein at a predetermined offshore location. The container is flooded with water to sink the container to the subwater surface at the location, and to float the barge in the vicinity of the open top of the container. Thereafter, the water within the container is dispersed with material such as a sand slurry suitable for supporting the barge in the vicinity of the top of the container.

21 Claims, 4 Drawing Figures

METHOD AND STRUCTURE FOR FORMING AN OFFSHORE FACILITY

BACKGROUND OF THE INVENTION

The present invention relates to construction of an offshore facility generally known as a retained island. More particularly, the present invention relates to the construction of a retained island suitable for drilling and/or production of minerals such as gas and/or liquid hydrocarbons.

Construction of retained islands to provide an offshore facility for the drilling and/or production of hydrocarbons is known. In the construction of such islands, a berm may be formed to raise the ocean floor to a predetermined level below the mean water level. The berm may be formed of any known land fill and generally has a flat plateau surface with downwardly and outwardly extending sloped surfaces from the plateau area to the ocean floor. One known method of completing the offshore facility is to float a barge to the berm and jacking or skidding the barge up onto the plateau surface of the berm. Thereafter, offshore drilling rigs and production equipment are installed on the barge. Thus, the prior art contemplates fabrication of the retained island and installation of facilities and equipment at the offshore location. Such offshore fabrication and installation is quite expensive due to the need for transportation of components to the site and the fabrication being conducted offshore and often in an hostile environment such as the Harrison Bay area of the Arctic Ocean off the north coast of Alaska.

SUMMARY OF THE INVENTION

In accordance with an aspect of the present invention, there is provided a method of constructing an offshore facility which comprises the steps of positioning an open top container having a barge therein at a predetermined offshore location. The container is flooded with water for sinking the container to the subwater surface at the location and for floating the barge up to the vicinity of the open top of the container. The water within the container is displaced with a material, such as a sand, gravel or silt slurry, suitable for supporting the barge within and in the vicinity of the open top of the container.

In accordance with another aspect of the present invention, there is provided a floatable structure for forming an offshore facility at a predetermined offshore location comprising an open top container including vertical outer surfaces having a height greater than the depth of the water at the location, and a barge within the container. The container is floodable with water for sinking it to the subwater surface at the location, and to float the barge in the vicinity of the open top of the container. The flooding water used to sink the container is displaceable from the container with a material, such as a sand slurry, suitable for supporting the barge within and in the vicinity of the top of the container.

Thus, the present invention provides for fully equipping, hooking up all equipment and components and precommissioning a special purpose barge in a fabrication yard. In a specific embodiment, the special purpose barge would be for the production of gas and/or liquid hydrocarbons, and all drilling and/or production equipment, including storage areas, living quarters, galley, would be constructed on the barge at the fabrication yard. In one embodiment, the structure comprising the container and the barge therein are floatable such that the structure may be towed to the predetermined offshore location, and the completed barge is placed over a simply constructed retained island in accordance with the present invention.

It is apparent that the construction of the offshore facility in accordance with the present invention avoids the expensive jacking or skidding up of barges onto berms and the fabrication and construction of equipment at the offshore site on the barge.

DESCRIPTION OF SPECIFIC EMBODIMENTS

Figure 1:
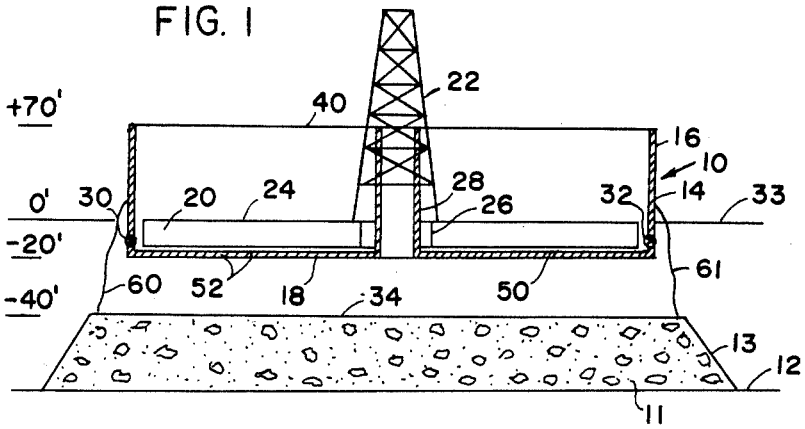
FIG. 1 is a side cross-sectional view of a container and barge in accordance with the present invention with the structure positioned over a submerged berm.
Figure 2:
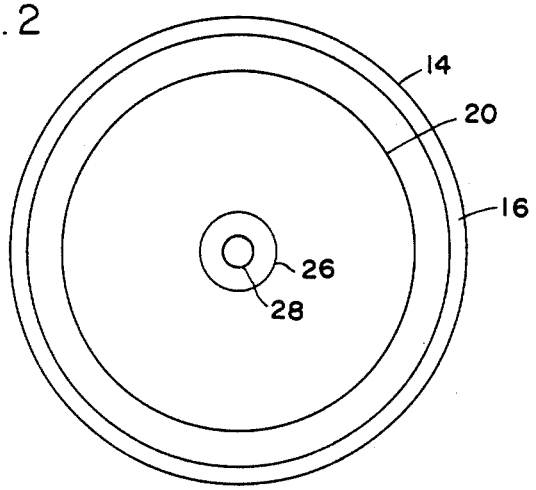
FIG. 2 is a top plan view of the structure of FIG. 1 without the drilling rig.

With reference to FIG. 1, a structure 10 is shown floating above a submerged berm 11 formed on the ocean floor 12. The structure 10 includes a circular container 14 having a vertical side wall 16 and a closed bottom 18. A barge 20 is positioned within the container 10 and is shown with a drilling rig 22 on its upper deck 24. In this embodiment, the barge 20 is also circular and includes a vertical hole 26 extending therethrough. The container 14 has a vertical cylindrical interior wall 28 forming a shaft in the center of the container 14 within the barge hole 26 such that both the container 14 and the barge 20 are doughnut-shaped.

Figure 3:
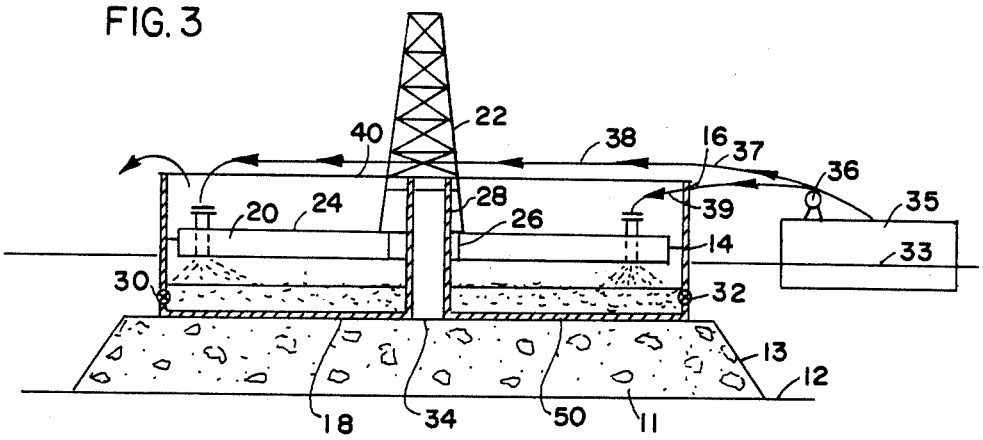
FIG. 3 is a side cross-sectional view of the structure of FIG. 1 with the container sunk to the plateau of the submerged berm and with a sand slurry being fed to the container to displace water.

In the position shown in FIG. 1, valves 30, 32 are opened in the bottom of the container 16 to permit seawater to enter therethrough and flood the interior of the container 16. The flooding action sinks the container 16 to the plateau portion 34 of the submerged berm 11 as shown in FIG. 3.

When the container 14 is seated on the plateau surface 34 of the submerged berm 11, the flooring valves 30, 32 are closed. In this position, the barge 20 is floating at about mean water level 33. A dredge barge 35 having at least one sand slurry pump 36 thereon, pumps a sand slurry through lines 37, 38, 39 into the container 14 to displace flooding water therefrom. The flooding water may flow over the open top 40 of the container 14 as indicated by the arrow and/or exit through valve operated perforations (not shown) in the side wall 16 of the container 14. The sand settles to the bottom of the container 14 and the barge 20 will rise with increasing water level within the container 14. The sand slurry lines 38 and 39 may optionally extend through the barge 20 and/or be fed between the outer surface of the barge 20 and the inner surface of the vertical wall 16 of the container 14. The sand slurry feed is continued until the container is filled with sand to a desired level. Water used to feed the sand slurry spills over the open top 40 of the container 14 as indicated by the arrow and/or through valve operated perforations (not shown) above the waterline 33.

In this position, drilling and production can be accomplished through the shaft 28. Risers and other completion lines can also extend through the shaft 28.

The container 14 or island retaining device can suitably be fabricated from high tensile, low temperature steel, e.g. A-633 or A-537, and have a wall thickness throughout of about 1–2 inches. In the specific embodiment described, the diameter of the container 14 may suitably be four-hundred feet and the vertical outer wall 16 and the shaft 28 may be ninety feet in height. The shaft 28 has a diameter of about fourty feet.

Also in the specific embodiment shown, the barge 20 may suitably be three-hundred-ninety feet in diameter, twenty feet in height and have relatively mild steel walls of ¾ inch thickness.

The barge 20 is suitably constructed within the container 14 at the onshore fabrication yard with all drilling and production equipment installed and all storage areas, living quarters, galley and other facilities hooked up and ready to operate such that it is commissioned at the fabrication yard.

By building the barge 20 within the container 14 the barge 20 may be lighter and of less strength than prior art barges used for retained islands because the barge 20, per se, does not need to be seaworthy. In the specific embodiment shown, the bottom surface 50 of the barge 20 is welded at points 52 to the bottom surface 18 of the container 14.

The submerged berm 11 is constructed with a downwardly and outwardly surface 13, to raise the ocean floor 12 to a predetermined level below the mean water level 33 which in this specific embodiment is forty feet. The berm 11 is formed by way one of the well known methods and does not require a perfect leveling of the plateau 34 because of the controllable leveling of the barge 20 during sand slurry fill of the container 14.

The combined strength of the container 14 and the barge 20 will be adequate for ocean transportation by towing. However, the present invention contemplates transporting the structure 10, including the container 14 and the barge 20, on a cargo barge (not shown) and sinking the cargo barge onto the submerged berm 11.

Figure 4:
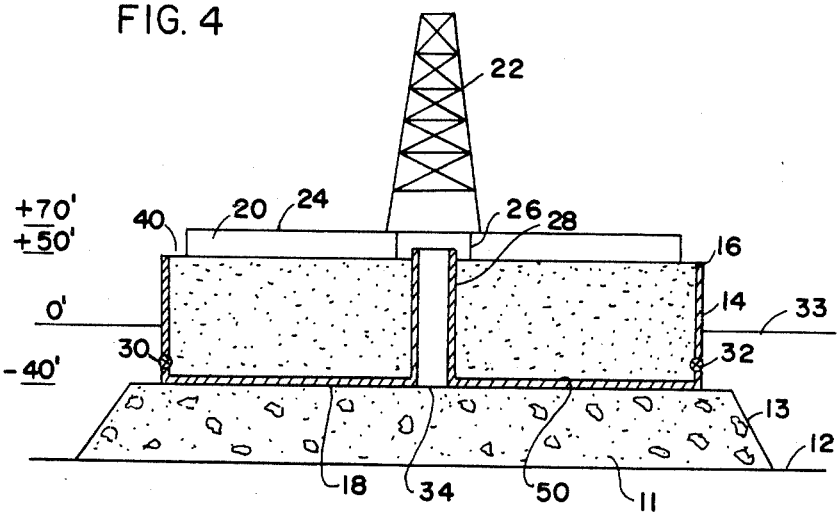
FIG. 4 is a side cross-sectional view of the structure of FIG. 1 showing the container seated on the submerged berm with said fill within the container to support the barge.

In the embodiment shown, it is contemplated that the structure 10 be towed to a predetermined location which may have a priorly formed berm 11, and the structure 10 is moored over the berm 11 by any suitable means such as mooring lines 60, 61. The barge 20 is disconnected from the container 14 by burning off the welds 52, and flooding of the container 14 is initiated by opening valves 30, 32. Flooding of the container 14 is continued until the container 14 settles on the plateau surface 34 of the berm 11. The barge 20 is thus free to float inside the container 14. The flooding valves 30, 32 are then closed, and then pumping of a sand slurry from the dredge barge 35 is commenced. The sand will settle in the lower portion of the container 14, thus displacing water over the open top 40 of the container 14. In the specific embodiment, sand is fed to the container 14 until the barge 20 is about forty feet above the mean waterline 33. The slurry water is then drained from the container 14, and, at this point, the top deck 24 of the barge 20 will be about sixty feet above mean waterline 33, and thus about twenty feet above the open top 40 of the container 14 as shown in FIG. 4. Representative relative heights of components of the structure 10 and the plateau 34 are shown in FIG. 1 before flooding of the container; and in FIG. 4 when the structure 10 is ready for use.

Th structure 10 is removed from the submerged berm 11 by reversing the foregoing process to remove the sand from the container 14 and thus float the structure off the berm 11.

Although the specific embodiment shows the structure 10 as being formed of concentric doughnut-shaped container 14 and barge 20, the present invention contemplates the container 14 and barge 20 having any suitable cross-sectional shape.

What is claimed is:

1. A method of constructing a retained island facility comprising the steps of:

positioning an open top container having a steel platform constructed of low temperature steel with a vertical hole therethrough, said platform including drilling and producing equipment for hydrocarbon production, storage areas, living quarters and galley, all completed for operation at a predetermined offshore location;

flooding said container with water for sinking said container to the subwater surface at said location and for floating said platform in the vicinity of the open top of said container; and displacing water within said container with material suitable for supporting said platform in the vicinity of the open top of said container.

2. The method of claim 1 further comprising initially forming a berm on the offshore floor to a predetermined level below the offshore waterline for receiving said container when said container is sunk at said predetermined location.

3. The method of claim 1 wherein said platform is fabricated within said container at an onshore fabrication yard, and is secured to said container for transportation to said predetermined location.

4. The method of claim 3 wherein said container and said platform secured therein are floatable, and wherein said container and said barge are towed to said predetermined location.

5. The method of claim 1 wherein said material is a sand slurry.

6. The method of claim 5 wherein said sand slurry is fed to said container from a dredge barge.

7. The method of claim 6 wherein the water is displaced from within said container by said sand slurry through the open top of said container.

8. The method of claim 1 wherein said container has a vertical height greater than the depth of the water at said location, whereby said open top of said container is above the water surface when said container is sunk to the subwater surface at said location.

9. The method of claim 1 wherein said container comprises a circular outer wall, vertical interior wall structure forming a shaft and a closed bottom between said shaft and said outer wall, and wherein said vertical hole in said platform receives said shaft of said container.

10. A method of constructing a retained island for production of minerals comprising the steps of:

positioning an open top container having a steel platform constructed of low temperature steel with a vertical hole therethrough, said platform including drilling and producing equipment for hydrogen production, storage areas, living quarters and galley, all completed for operation at a predetermined offshore location; said container comprising vertical outer wall surfaces greater than the depth of the water at said location, and interior vertical wall surfaces forming a shaft therethrough; said platform having a vertical hole for receiving said shaft of said container;

flooding said container with water for sinking said container to the subwater surface at said location and for floating said platform in the vicinity of the open top of said container; and displacing water within said container with material suitable for supporting said platform in the vicinity of the top of said container.

11. The method of claim 10 further comprising initially forming a berm on the offshore floor to a predetermined level below the offshore waterline for receiving said container when said container is sunk at said predetermined location.

12. The method of claim 10 wherein said platform is fabricated within said container at an onshore fabrication yard, and is secured to said container for transportation to said predetermined location.

13. The method of claim 12 wherein said container and said platform secured therein are floatable, and wherein said container and said barge are towed to said predetermined location.

14. The method of claim 10 wherein said material is a sand slurry.

15. The method of claim 14 wherein said sand slurry is fed to said container from a dredge barge.

16. The method of claim 15 wherein the water is displaced from within said container by said sand slurry through the open top of said container.

17. The method of claim 10 wherein said container has a vertical height greater than the depth of the water at said location, whereby said open top of said container is above the water surface when said container is sunk to the subwater surface at said location.

18. The method of claim 10 wherein said container comprises a circular outer wall, vertical interior wall structure forming a shaft and a closed bottom between said shaft and said outer wall, and wherein said vertical hole in said platform receives said shaft of said container.

19. A floatable structure for forming a retained island at a predetermined offshore location comprising:

an open top, low temperature steel container including vertical outer surfaces having a height greater than the depth of water at said location, and a steel platform within said container;

said container being floodable with water for sinking said container to the subwater surface at said location and for floating said platform in the vicinity of the open top of said container;

whereby the flooding water is displaceable from said container with materials suitable for supporting said platform within said container in the vicinity of the open top thereof.

20. The structure of claim 19 wherein said container comprises a circular outer wall, vertical interior wall structure forming a shaft and a closed bottom between said shaft and said outer wall, and wherein said platform includes a vertical hole therethrough for receiving said shaft of said container.

21. The structure of claim 19 wherein said platform includes equipment for drilling and production of hydrocarbons.

* * * * *